United States Patent [19]

Mommsen

[11] Patent Number: 4,462,061

[45] Date of Patent: Jul. 24, 1984

[54] AIR TURBINE DRIVE FOR ELECTROSTATIC SPRAY GUN

[75] Inventor: Gordon V. Mommsen, Brooklyn Center, Minn.

[73] Assignee: Graco Inc., Minneapolis, Minn.

[21] Appl. No.: 508,881

[22] Filed: Jun. 29, 1983

[51] Int. Cl.[3] ..... B05B 5/00

[52] U.S. Cl. ..... 361/227; 239/692; 239/700; 239/707; 361/235

[58] Field of Search ..... 361/227, 228, 235; 239/690, 692, 699, 700, 706, 707

[56] References Cited

U.S. PATENT DOCUMENTS

| | | | |
|---|---|---|---|
| 3,610,528 | 10/1971 | Felici | 239/692 |
| 3,653,592 | 4/1972 | Cowan | 361/227 |
| 3,731,145 | 5/1973 | Senay | 361/235 |
| 4,219,865 | 8/1980 | Malcolm | 361/228 |
| 4,290,091 | 9/1981 | Malcolm | 361/228 |
| 4,377,838 | 3/1983 | Levey et al. | 361/228 |

*Primary Examiner*—Reinhard J. Eisenzopf

[57] ABSTRACT

An electrostatic spray gun having a rotatable voltage generator for providing electrical energy at low voltage for conversion within the spray gun into electrostatic high voltage energy, wherein a rotating voltage generator is driven by an air turbine under the influence of a pressurized input air supply, the pressurized air passing through conduits in the handle of the spray gun, an air valve actuated by a trigger, an air flow regulator, and into impinging contact against rotatable turbine blades. The air supply is exhausted from the spray gun through internal passages which provide cooling air to the electrical components within the spray gun, and through further passages opening from the bottom of the spray gun handle which minimize the audible noise caused by such air flow.

10 Claims, 3 Drawing Figures

AIR TURBINE DRIVE FOR ELECTROSTATIC SPRAY GUN

BACKGROUND OF THE INVENTION

The present invention relates generally to electrostatic paint spray guns, and more particularly to electrostatic spray guns of the type developing an internal high voltage in circuitry which steps up a relatively low voltage generated by a rotating generator, wherein the generator is driven by an air turbine. The present invention particularly relates to an improvement in providing controlled pressurized air to the spray gun for the purposes of driving the air turbine, cooling components within the gun and exhausting the pressurized air with minimum noise.

Electrostatic paint spray guns have been recently developed and invented utilizing the concept of a primary power source being derived from a rotating air turbine member. Such a gun is described in U.S. Pat. Nos. 4,377,838, 4,219,865, and 4,290,091, and reference may be had to these patents for a detailed understanding of the theory of operation of guns of this type. Air turbine electrostatic spray guns require a source of pressurized air to be delivered to the gun, typically at pressures ranging from 30–60 pounds per square inch (psi). Prior art spray guns have utilized a pressurized hose attached to the handle of the spray gun, wherein the pressurized air is delivered through internal conduits to impinge upon turbine blades which are rotatable under the influence of this air. The exhaust air from such spray guns has been typically passed through the rear of the spray gun through a suitable muffler to reduce the audible noise produced by such air.

Air turbine electrostatic spray guns typically have a mechanically coupled electrical generator attached to a rotatable turbine, the generator generating a low voltage alternating current (AC) signal which is stepped up to an intermediate high volage AC signal through an oscillator and transformer circuit, coupled to a cascade voltage multiplier of the Cockcroft-Walton type. The cascade voltage multiplier is usually designed to develop an output DC voltage in the range of 50,000–80,000 volts.

The process of converting pressurized air input into this high voltage energy results in certain energy losses which produce heat inside of the spray gun. The spray gun body is typically constructed of an insulated plastic material, which is also a good heat insulator, and the internal heat generated by the mechanical and electrical components is not readily radiated from the gun. Excessive heat build-up can damage or destroy the mechanical and electrical components therein, and therefore care must be taken in designing such spray guns to provide means for dissipating the heat. The problem of internal heat build-up is further complicated by the need for reducing the overall physical size of the spray gun so that it may be manufactured in a compact package for easy handling by an operator. It is also desirable to make the gun as light in weight as possible, all of which makes it difficult to design into the gun the appropriate metallic heat conductors which might otherwise draw heat from the electrical components. The problem of removing excessive heat from such spray guns is addressed by the present invention, while at the same time controlling the air flow rate and minimizing the audible noise caused by the exhaust of the pressurized air supply to the gun.

SUMMARY OF THE INVENTION

The present invention includes an air turbine electrostatic spray gun having internal air passages adapted for connection to an external source of pressurized air, wherein air is delivered through a flow rate controller into impinging contact against rotatable turbine blades in a turbine drive chamber, and is exhausted from the turbine drive chamber to pass over the heat generating components of the spray gun, and is diverted back into the spray gun handle for exhausting into the atmosphere. The path of travel of the pressurized air through the internal spray gun passages provides both a source of cooling air for the heat generating components of the spray gun and a routing of the pressurized air so as to minimize the audible noise caused by the air as it exhausts from the spray gun.

BRIEF DESCRIPTION OF THE DRAWING

The invention will become apparent from the following specification and claims, and with reference to the appended drawings, in which:

DESCRIPTION OF THE EMBODIMENT

Figure 1:
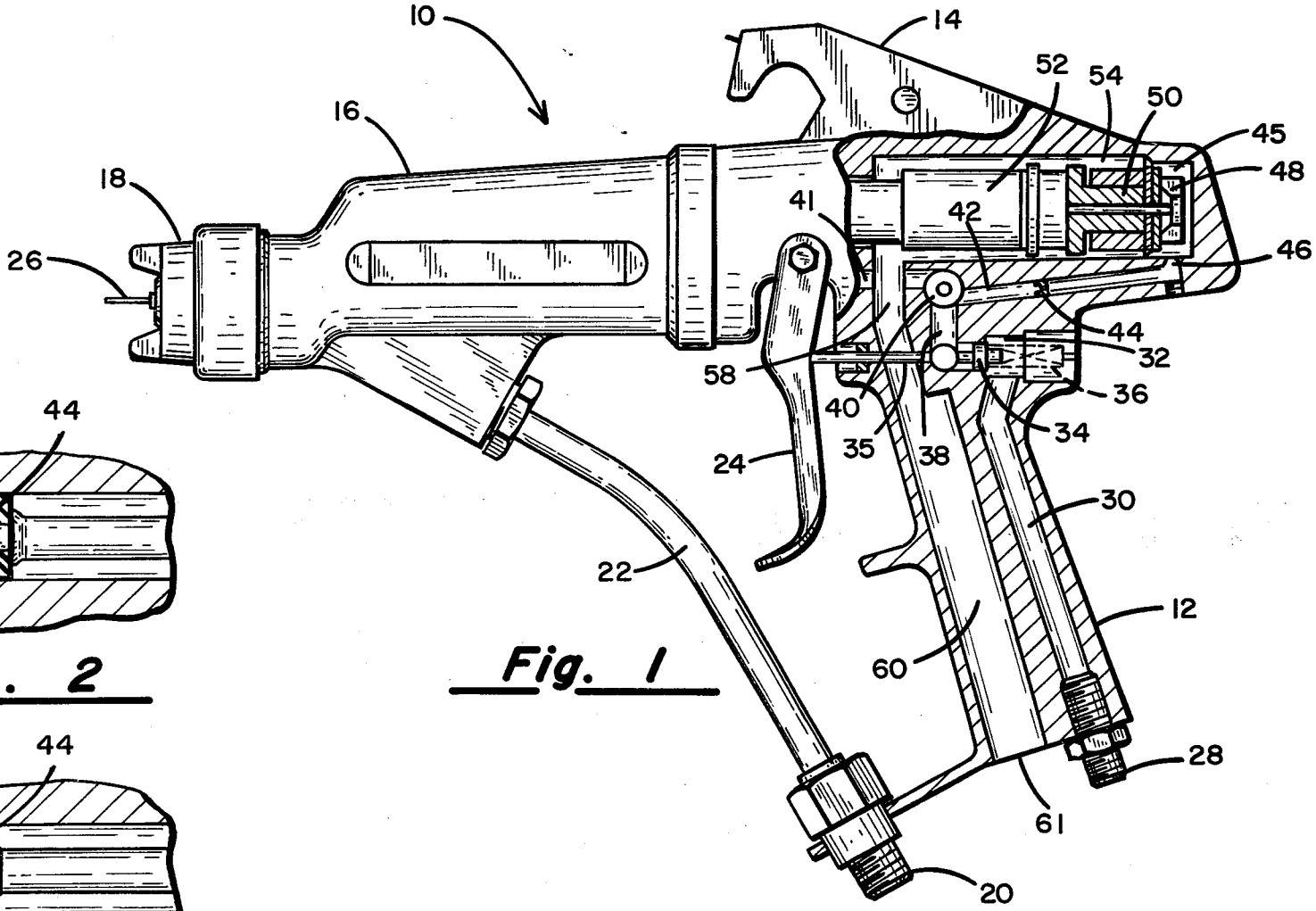
FIG. 1 shows the invention in elevation view and in partial cross section.

Referring to FIG. 1, there is shown a spray gun 10 in elevation view and in partial cross section to illustrate the invention described herein. Spray gun 10 typically has a handle 12 which is attached to a body 14, and a barrel 16 which is also attached to body 14. Barrel 16 has attached proximate its front end a spray nozzle 18 which is adapted for emitting sprayed particles of liquid. Liquid is admitted into spray gun 10 at connector 20, and passes through a tube 22 which is connected to barrel 16. Internal passages (not shown) convey the liquid into the vicinity of nozzle 18 where a spray valve is located for releasing the liquid into the atmosphere. The spray valve is controlled by actuation of trigger 24 which is pivotally attached to body 14. A high voltage potential is developed in spray gun 10, and is conveyed via conductors to an electrode 26 which projects from the front of nozzle 18. The source of pressurized air is connected to connector 28, and is conveyed through passages inside of the gun to be hereinafter described.

A passage 30 passes through handle 12 of spray gun 10, in flow communication at one of its ends with connector 28, and terminating at its other end in chamber 32. Chamber 32 has therein an air valve 34 which is seated to block the flow of pressurized air from chamber 32 to any further passages inside the spray gun. Air valve 34 is biased in its seated position by a compression spring 36 in chamber 32. Air valve 34 is actuated by trigger 24, through a valve stem 35 which enables the unseating of valve 34 against the resistance force of spring 36. When trigger 24 is squeezed air valve 34 unseats from its blocking relationship to air passages in the spray gun, and pressurized air is conveyed into passage 38.

Passage 38 is coupled to plenum 40, which diverts pressurized air in two directions, through passage 41 and also through passage 42. Air flow through passage 41 is used to provide pressurized air to assist in atomizing the paint spray emitted from nozzle 18, and is of only secondary interest to the present invention. Air passing through passage 42 passes through an air flow regulator 44 which will be described in greater detail hereinafter. The output of air flow regulator 44 is conveyed via passage 46 into turbine chamber 45. Turbine chamber 45 houses a rotatable turbine blade member 48, and air is ported from passage 46 so as to directly impinge upon the turbine blade member 48. Turbine blade member 48 is a rotatable member having a plurality of blades positioned about its circumference so as to cause rotation of a shaft attached thereto in response to the impingement of pressurized air. The shaft attached to turbine blade member 48 rotates an electrical generator 50 which generates a low voltage that is coupled into a step-up transformer 52 and transformed into an intermediate high voltage. This high voltage is coupled into a cascade voltage multiplier of the Cockroft-Walton type, which multiplier is housed in barrel 16 (not shown), and which has an output conductor electrically connected to electrode 26. Alternatively, the output of generator 50 may be connected into a further voltage oscillator circuit for generating a higher frequency signal, which signal is then transformed through a transformer and coupled into a cascade voltage multiplier circuit. In any event, the mechanical linkage to turbine blade member 48 is coupled to drive suitable electrical components for providing the necessary high voltage from the spray gun. The rotating components associated with this drive concept generate mechanical heat, and the electrical components associated with the voltage generating end transforming circuits generate considerable electrical heat. The primary heat generating members are all located within gun body 14, and it is desirable to provide a heat dissipating mechanism within the spray gun to protect and cool these components.

The pressurized air which is utilized to rotate turbine blades 48 is exhausted from turbine chamber 45 into exhaust chamber 54. Exhaust chamber 54 is sized so as to provide unrestricted air flow about all of the mechanical and electrical components in body 14. A passage 58 is coupled in flow communication with exhaust chamber 54, and passage 58 is coupled to exhaust passage 60. Exhaust passage 60 opens to the atmosphere through opening 61, thereby to release the exhaust air downwardly and in a direction away from the paint particles emitted from nozzle 18.

Figure 2:
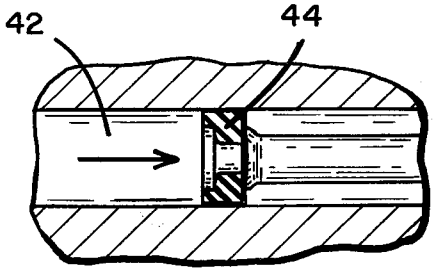
FIG. 2 shows a cross section of the air flow rate controller.
Figure 3:
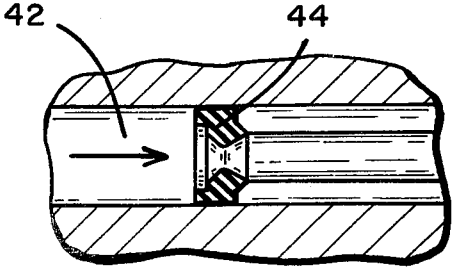
FIG. 3 shows a further cross section of the air flow rate controller.

FIG. 2 shows air flow regulator 44 in expanded cross sectional view. The flow of air is in the direction of the arrow, passing from passage 42 into air flow regulator 44, and therethrough. FIG. 3 shows air flow regulator 44 under conditions of excess pressure operation, whereas FIG. 2 shows air flow regulator 44 under conditions of normal pressure operation. Air flow regulator 44 is a resilient O-ring having special design characteristics. Air flow regulator 44 may be selected from products manufactured for that purpose by Vernay Laboratories, Inc., Yellow Springs, Ohio, as for example the Vernay product designated as Model VA-3636, which has been found to be adequate and useful for the intended purpose in connection with this invention. Under circumstances of normal pressure, regulator 44 provides a smooth opening through which pressurized air may flow. If pressure builds up beyond a predetermined limit it causes deformation of the resilient material of which regulator 44 is constructed, as is shown in FIG. 3. This deformation results in an overall reduction in the cross sectional flow area through regulator 44, and restricts the rate of flow of air therethrough. Materials may be selected which provide a relatively constant air flow rate over wide pressure variations, as for example a plus or minus 10% flow rate variation over pressures ranging from 20–100 pounds per square inch (psi). Control over this air flow rate is extremely important in connection with the present invention, for it is the rate of air flow which determines the speed of rotation of turbine blade member 48. Unrestricted air flow into turbine chamber 45 could cause wide variations in rotational speed of turbine blade member 48, and consequent wide swings in the amount of heat generated by the mechanical and electrical components which are connected to turbine member 48.

In operation, a source of pressurized air is connected to connector 28, and a source of pressurized paint or other liquid is connected to connector 20. When trigger 24 is depressed it causes the pressurized air to become emitted into the various internal passages of the spray gun, some of which may be directed toward the front of the gun to assist in the atomization of the emitted particles. A portion of the internal air is delivered through the air flow regulator under controlled flow rate conditions to rotate turbine blades 48 at a relatively constant rate. This causes the electrical generating members to generate a relatively constant voltage which is multiplied via the cascade multiplier to generate a fairly constant high voltage at electrode 26. After the air has been utilized in the turbine chamber for purposes of rotating the turbine member it is exhausted through an exhaust chamber which surrounds the electrical and mechanical components in the body of the gun. The air passing over these components dissipates heat generated therein, and conveys this excess heat into the exhaust passage in the handle of the spray gun. Finally, air is exhausted from the bottom of the handle of a spray gun in a downwardly and rearwardly direction, wherein the emission is directed away from the operator with a resultant reduction in audible noise. Further, the circuitous path of the air flow as it is directed through the internal spray gun passages tends to muffle air flow sound and to reduce the overall sound emitted from opening 61. Still further, since the exhaust air is directed downwardly and rearwardly, it does not disturb the pattern of particles being emitted from nozzle 18 of the spray gun. All of these factors serve to greatly increase the reliability and convenience of operation of the spray gun, and to provide operating conditions to enable a fine quality of spray to be developed and emitted from the nozzle of the spray gun.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An electrostatic spray gun having an internal air turbine mechanically linked to a rotatable electric generator and electric circuitry coupled to said generator for developing high voltage in response to pressurized air delivered to said gun, comprising:

(a) an air coupler attached to said gun for receiving said pressurized air;

(b) an internal passage in said gun passing between said air coupler and said air turbine;

(c) an externally actuable air valve in said passage for opening and closing said passage;
(d) an air flow regulator in said passage;
(e) an exhaust chamber in said gun at least partially surrounding said generator and said circuitry and coupled in air flow connection to said turbine; and
(f) an exhaust passage in said gun connected to said exhaust chamber and opening external said gun.

2. The apparatus of claim 1, wherein said gun further comprises a body having a handle and barrel attached thereto, and said air coupler is attached to said handle.

3. The apparatus of claim 2, wherein said internal passage further comprises a passage through said handle and said air valve is located in said handle passage.

4. The apparatus of claim 2, wherein said air turbine and generator are contained in said body and said exhaust chamber further comprises a cavity in said body substantially surrounding said turbine and said generator.

5. The apparatus of claim 4, wherein said exhaust passage further comprises a passage through said handle, connected at one of its ends to said exhaust chamber and opening through the handle at its other end.

6. The apparatus of claim 5, wherein said air flow regulator further comprises a resilient O-ring in said passage, said O-ring being deformable to constrict an opening therethrough under the influence of predetermined excess air pressure.

7. An electrostatic spray gun having a barrel for emitting particles and having an electrode projecting therefrom, a handle for grasping, and a body attached to said barrel and said handle, said body having a pivotal trigger attached thereto and enclosing an air turbine and electrical voltage generating components, comprising:
(a) an air connector attached to said handle and first passages in said handle coupled to said air connector and extending into said body;
(b) a second passage in said body coupling between said first passage and said air turbine in air flow relationship, and an air flow regulator in said second passage;
(c) a cavity in said body about said air turbine and said electric voltage generating components, said cavity being in air flow coupling relationship to said air turbine;
(d) a third passage coupled between said cavity and said handle, said third passage passing through said handle and opening external said handle.

8. The apparatus of claim 7, further comprising a valve in said first passage, said valve having an actuator stem passing through said handle to an actuating position proximate said trigger.

9. The apparatus of claim 8, wherein said air flow regulator further comprises a deformable resilient ring in said second passage.

10. The apparatus of claim 9, wherein said first and third passages are substantially parallel over at least a portion of their respective lengths in said handle.

* * * * *